US008872362B2

(12) United States Patent
Lee et al.

(10) Patent No.: US 8,872,362 B2
(45) Date of Patent: Oct. 28, 2014

(54) SOLE FOR A FOOTWEAR

(75) Inventors: Neville Ka Shek Lee, Hong Kong (CN); Chi Kit Chan, Hong Kong (CN); Samuel Sing-Kwong Hui, Hong Kong (CN)

(73) Assignee: Cedar Technologies International Ltd., Hong Kong (CN)

( * ) Notice: Subject to any disclaimer, the term of this patent is extended or adjusted under 35 U.S.C. 154(b) by 492 days.

(21) Appl. No.: 13/382,333

(22) PCT Filed: Jul. 6, 2010

(86) PCT No.: PCT/US2010/041018

§ 371 (c)(1),
(2), (4) Date: Jan. 5, 2012

(87) PCT Pub. No.: WO2011/005728

PCT Pub. Date: Jan. 13, 2011

(65) Prior Publication Data

US 2012/0096746 A1 Apr. 26, 2012

Related U.S. Application Data

(60) Provisional application No. 61/270,161, filed on Jul. 6, 2009.

(51) Int. Cl.
*F02B 63/04* (2006.01)

(52) U.S. Cl.
USPC ..... 290/1 R; 290/1 A

(58) Field of Classification Search
USPC ..... 290/1 R, 1 A, 52
See application file for complete search history.

(56) References Cited

U.S. PATENT DOCUMENTS

| | | | | |
|---|---|---|---|---|
| 4,736,530 | A * | 4/1988 | Lakic et al. | 36/2.6 |
| 4,756,095 | A * | 7/1988 | Lakic | 36/2.6 |
| 5,341,581 | A * | 8/1994 | Huang | 36/3 B |
| 5,500,635 | A * | 3/1996 | Mott | 340/323 R |
| 6,115,942 | A | 9/2000 | Paradis | |
| 6,201,314 | B1 * | 3/2001 | Landry | 290/54 |
| 6,239,501 | B1 * | 5/2001 | Komarechka | 290/1 R |
| 6,281,594 | B1 | 8/2001 | Sarich | |
| 6,594,917 | B2 * | 7/2003 | Ricco' et al. | 36/3 R |
| 6,744,145 | B2 * | 6/2004 | Chang | 290/1 R |
| 6,865,825 | B2 * | 3/2005 | Bailey et al. | 36/88 |
| 7,204,041 | B1 | 4/2007 | Bailey, Sr. et al. | |
| 7,219,449 | B1 | 5/2007 | Hoffberg et al. | |
| 7,395,614 | B1 | 7/2008 | Bailey, Sr. et al. | |
| 7,956,476 | B2 * | 6/2011 | Yang | 290/1 R |

(Continued)

OTHER PUBLICATIONS

ISR for International App. No. PCT/US10/41018 dated Aug. 9, 2010.

*Primary Examiner* — Nicholas Ponomarenko
(74) *Attorney, Agent, or Firm* — Leydig, Voit & Mayer Ltd.

(57) ABSTRACT

A sole for footwear including a body having a length, a body portion of the body that is capable of expansion and contraction, and a drive generator located in the body for generating drive to drive a driven device in the body. The drive generator has an elongate drive member arranged to slide relative to the body portion in a direction along the length of the body, upon expansion and contraction of the body portion, for driving the driven device as the sole bends and unbends during use.

30 Claims, 20 Drawing Sheets

(56) References Cited

U.S. PATENT DOCUMENTS

| | | | | |
|---|---|---|---|---|
| 8,013,463 | B2 * | 9/2011 | Preston | 290/54 |
| 2004/0118831 | A1 | 6/2004 | Martin | |
| 2007/0089321 | A1 | 4/2007 | Yeh | |
| 2007/0180736 | A1 | 8/2007 | DiBenedetto et al. | |
| 2008/0141559 | A1 | 6/2008 | Marc | |
| 2012/0049538 | A1 | 3/2012 | Periasamy et al. | |

* cited by examiner $l'_1 < l'_0 < l'_2$ $l_1 = l_0 = l_2$

SOLE FOR A FOOTWEAR

The present invention relates to a sole for a footwear. More particularly, although not exclusively, the invention relates to a modified sole.

BACKGROUND OF THE INVENTION

It has been known that there are numerous examples of footwear mechanism actuated by means of heel-based pressure, applied when the user steps down. The most common being weight-based pump ventilated footwear. However, this type of footwear is known to be uncomfortable and affects the stability of the footwear because of the vertical heel movement required to actuate the mechanism.

The weight-based pump can be provided in the sole. The sole must be thickened to give room for the pump. This affects the appearance of the footwear.

Thus in the few commercialized designs for weight-based designs, the pump has been made to be quite small thus limiting the negative impacts on stability but also adversely affecting the ventilating abilities of the pump as well.

OBJECT OF THE INVENTION

It is an object of the present invention to overcome or substantially ameliorate at least one of the above disadvantages.

SUMMARY OF THE INVENTION

There is disclosed herein according to the first aspect of the invention a sole for a footwear comprising a body having a length, a body portion of the body capable of expansion and contraction; and a drive generator provided in the body for generating drive to drive a device in the body; wherein the drive generator comprises an elongate drive member arranged to slide relative to the body portion in a direction along the length thereof upon expansion and contraction of the body portion for driving said device, as the sole bends and unbends during use.

Preferably, the drive member is maintained in close proximity to the body portion.

It is preferable that the sole includes a guide that maintains the drive member in close proximity to the body portion while allowing sliding of the drive member relative to the body portion.

It is more preferable that the sole includes a holder that holds a part of the drive member to the body.

Preferably, the holder comprises a fastener fastening a portion of the drive member to the body.

More preferably, the holder comprises a direction-changing element, and the drive member runs over the direction-changing element to change the direction of sliding of a portion of the drive member when the drive member slides.

Furthermore preferably, the drive member passes the body portion at least two times by running over at least one said direction-changing element so as to amplify displacement of the drive member relative to the body portion for increasing the drive.

Yet more preferably, the direction-changing element comprises a roller.

Yet further more preferably, the drive member passes the body portion a plurality of times to proportionally amplify the displacement of the drive member.

Further preferably, the drive member extends along a boustrophedonic path by passing the body portion for a plurality of times.

It is more preferable, the holder comprises a lever which has a part in engagement with the drive member and is arranged to pivot between first and second positions in response to bending and unbending of the sole so as to cause the drive member to slide relative to the body portion when the lever pivots between the first and second positions.

More preferably, the lever includes a direction-changing element which is provided at said part and over which the drive member slides in response to bending and unbending of the body.

Yet more preferably, the drive member is tensioned by a resiliently deformable element connected therewith.

Preferably, the resilient deformable element comprises a spring.

More preferably, the drive generator includes a second drive member which is connected to the elongate drive member for moving by the elongate drive member so as to change the direction of drive generated by the elongate drive member.

Yet more preferably, the second drive member comprises a rotational pivot, a pivoted lever, a gear or a friction wheel.

Further more preferably, the elongate drive member is substantially inelastic.

Preferably, the elongate drive member comprises one of a thin plate, a ribbon and a cable made of Dyeema or Kevlar.

More preferably, the drive generator includes a mechanical energy storage device connected to the drive member for storage of energy.

Yet more preferably, the mechanical energy storage is in serial connection for outputting the drive from the drive member to said device.

Further more preferably, the device comprises a fan or an electrical generator or a bulb.

Yet further more preferably, the body has a thickness within which the drive generator is provided in the body.

More preferably, the elongate drive member is arranged to flip relative to the portion of the body in upward and downward direction substantially perpendicular to the length of the body for driving said device, as the sole bends and unbends during use.

There is disclosed herein according to the second aspect of the invention sole for a footwear comprising a body having a wall, a drive generator provided in the body for generating drive to drive a device in the body; wherein the drive generator comprises an elongate drive member fixed onto the wall and arranged to flip relative to the body in upward and downward direction substantially perpendicular to a length of the wall for driving said device, as the sole bends and unbends during use.

Preferably, the drive generator includes a second drive member which is connected to the elongate drive member for moving by the elongate drive member so as to change the direction of drive generated by the elongate drive member.

More preferably, the elongate drive member has a first end attached to the body and a second end unattached, as the sole bends, the second end flips in a direction away from the body Further more preferably, the body has an opening on its bottom wall, through which a part of the elongate drive member is displaced outside the body as the sole bends.

Yet more preferably, the wall comprises a bottom wall of the body.

More preferably, the elongate drive member is a rigid member.

BRIEF DESCRIPTION OF THE DRAWINGS

The invention will now be more particularly described, by way of example only, with reference to the accompanying drawings, in which.

DETAILED DESCRIPTION OF PREFERRED EMBODIMENTS

Referring to FIGS. 1 to 15 of the drawings in general, there is shown a sole 1 for a footwear embodying the invention. The sole 1 has a number of basic components, namely a body 2 containing a drive generator for generating a drive to drive a device 4.

The body 2 has a certain length and thickness to accommodate at least a portion of the drive generator and the device 4. Within the length and thickness, the body 2 has a body portion 5. This body portion 5 is resiliently deformable and is elastic such that it can be expanded or contracted upon bending of the sole 1 when the wearer moves his foot, such as during walking or running. In an embodiment of the invention, the body portion 5 is a part of an upper wall 2*a* or lower wall 2*b* of the body 2. In a further embodiment, the body portion 5 is the whole of the upper or lower wall 2*a* and 2*b* of the body 2.

Figure 1B:
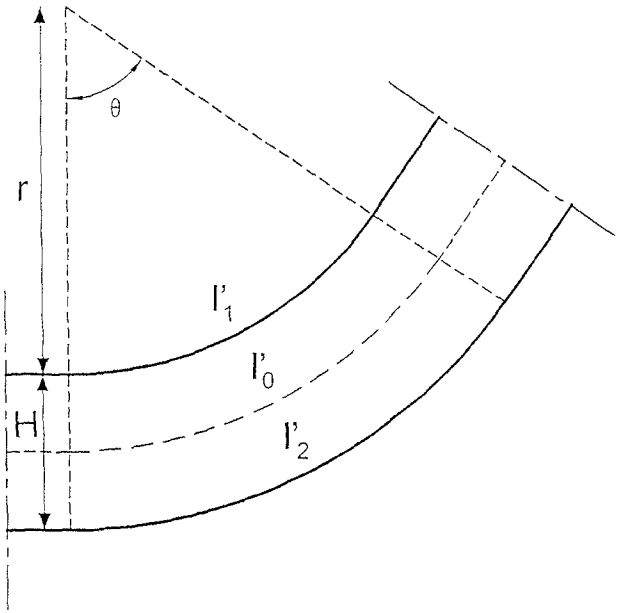
FIG. 1*b* is a cross-sectional view of the part of the body when it is bent.
Figure 1A:
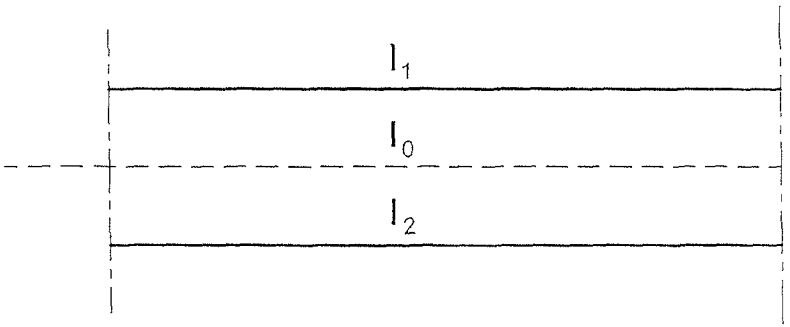
FIG. 1*a* is a cross-sectional view of a part of a body of an embodiment of a sole in accordance with the invention when the sole and the body is unbent.

When the sole 1 or the body 2 is bent or deformed, the upper wall 2*a* is contracted lengthwise while the lower wall 2*b* is stretched or expanded lengthwise. This effect is shown in FIGS. 1*a* and 1*b*. For simplicity of discussion, the material of the body 2 as shown in FIG. 1 is uniform, elastic and compressible.

In FIG. 1*a*, when the body 2 is in the default state, the length $l_1$ of the upper wall 2*a* and the length $l_2$ of the lower wall 2*b* are equal to the length $l_0$ between length $l_1$ and length $l_2$. When the sole 1 and the body 2 is bent, as shown in FIG. 1*b*, the length $l_1$ is shortened/compressed to $l'_1$ while the length $l_2$ is lengthened/expanded to $l'_2$. The length $l_0$ is lengthened or expanded to $l'_0$. By simple geometric consideration, the amount of the shortening/compression $\Delta l$ of $l'_1$ is:

$$\Delta l'_1 = l'_0 - l'_1 \approx \theta H/2$$

Similarly the amount of expansion of the lower wall 2*b* of the body 2 $\Delta l$ of $l'_2$ is:

$$\Delta l'_2 = l'_2 - l'_0 \approx \theta H/2,$$

where $\theta$ is the bending angle of the body 2, and H is the thickness of the body 2.

An embodiment of the invention is shown in FIGS. 2*a* to 2*d*. The drive generator includes an elongate drive member 6 in the form of a cable that is substantially inelastic. It can also be a plate, thread, ribbon, board or a cable of Dyeema or Kevlar. In this embodiment, the lower wall 2*b* is the body portion 5. The holder is in a form of a fastener 7. The fastener 7 fastens one end of the cable 6 to the lower wall 2*b* near tip of the body 2. A device 4 is connected to the other end of the cable 6. In the preferred embodiment, the device 4 is a ventilator.

The cable 6 is arranged to slide relative to the body portion 5 upon expansion and contraction of the body portion 5 to drive the device 4 as the sole 1 and the body 2 bend and unbend during use. Six guides 10 are provided to maintain the cable 6 in close proximity to the body portion 5. These guides 10 define a path 10*a* on the body portion 5 for the cable 6.

The ventilator 4 has a piston 8 slidable in a body and includes a resiliently deformable element or resilient biasing member, in the form of a helical spring 9. The helical spring 9 is connected to one end of the piston 8 and the cable 6 is attached to the opposite end of the piston 8. The cable 6 is tensioned by the spring 9.

Figure 2A:
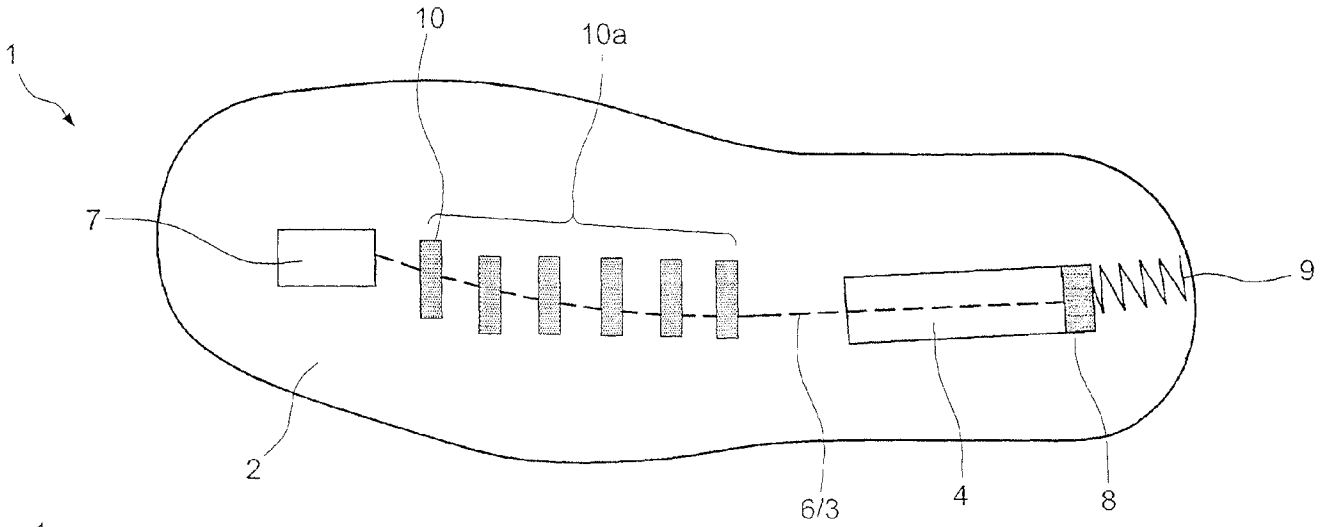
FIG. 2*a* is a top plan view of whole of the body of the sole in FIGS. 1*a* and 1*b* with the elongate drive member fastened to a lower wall of the body.
Figure 2B:
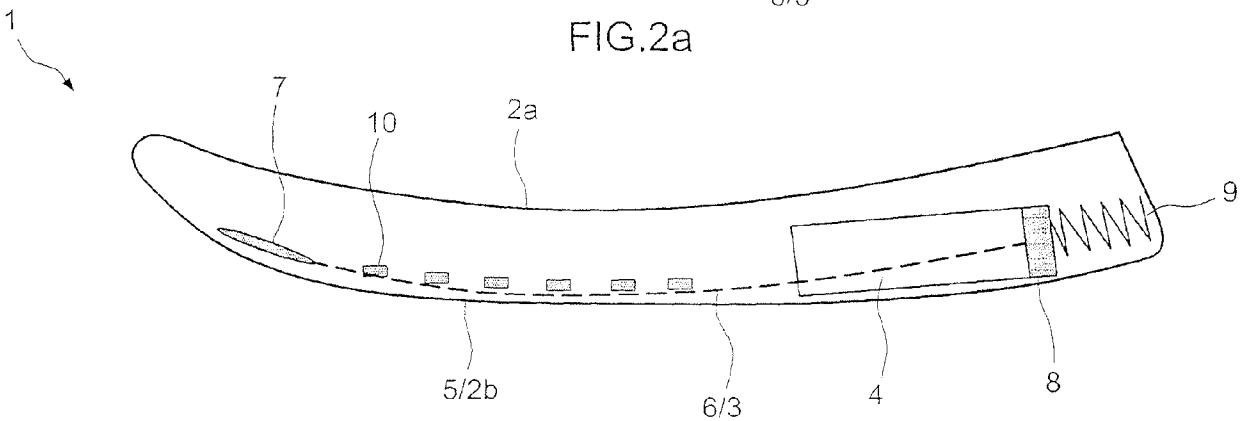
FIG. 2*b* is a cross-sectional view of the body in FIG. 2*a;*
Figure 2C:
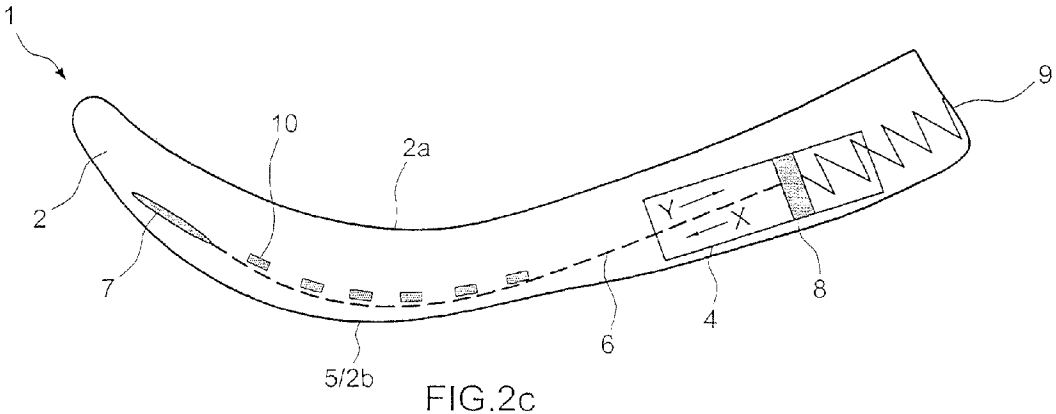
FIG. 2*c* is a cross-sectional view of the body in FIG. 2*a* when it is bent.
Figure 2D:
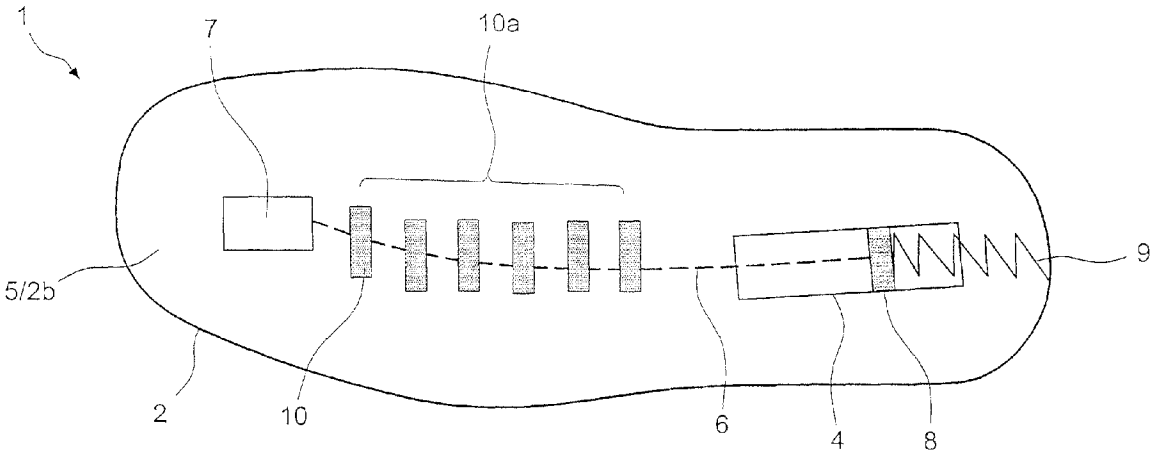
FIG. 2*d* is a top plan view of the body in FIG. 2*c;*

The wearer, by lifting his heel, bends the sole 1 and the body 2. When the sole 1 and the body 2 are bent, the lower wall 2*b* is expanded or stretched. The cable 6 slides relative to the lower wall 2*b* in the path 10*a* and in the direction X as shown in FIG. 2*c*. The cable 6 pulls the piston 8 causing it to apply a stretching force on the spring 9. The piston 8 moves and the spring 9 is extended. Air is pushed out of the ventilator 4 by the piston 8.

When the sole 1 and the body 2 are unbent, the lower wall 2*b* is returned to its default state. The spring 9 automatically biases the piston 8 to restore the piston 8 to its original position as shown in FIGS. 2*a* and 2*b*.

The cable 6 slides relative to the lower wall 2*b* in direction Y as shown in FIG. 2*c*. Air is sucked into the ventilator 4.

The movement of the piston 8 inwardly and outwardly relative to the body of the ventilator 4 brings about ventilation of the sole 1. A vent hole is provided through the wall of the body 2 to permit airflow into and out of the body 2.

Figure 3A:
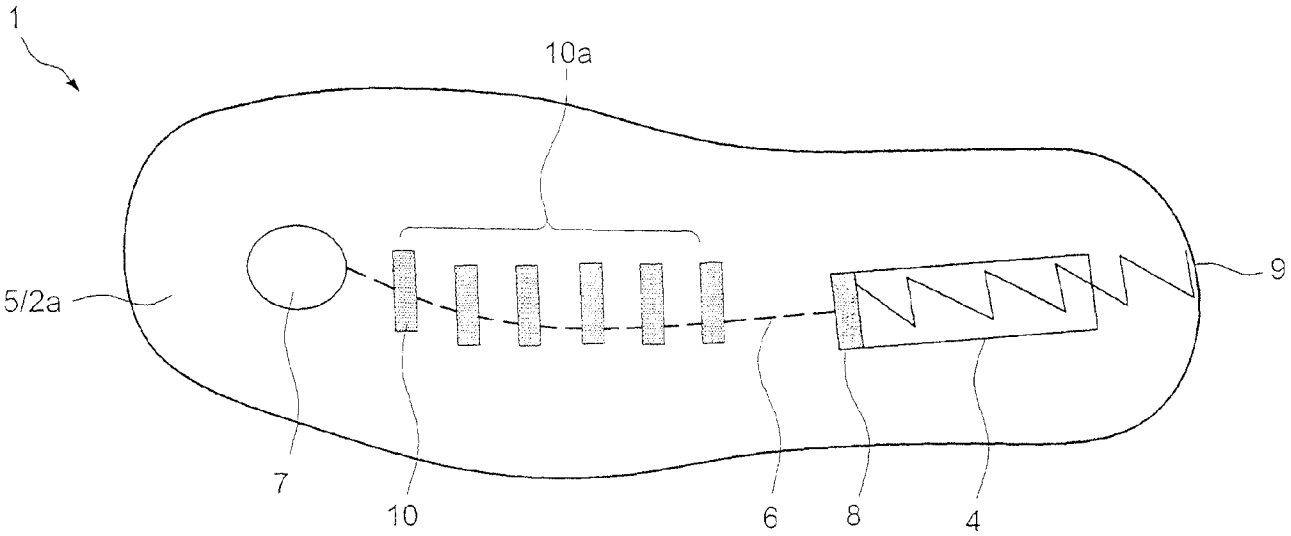
FIG. 3*a* is a top plan view of the body of the sole in FIGS. 1*a* and 1*b* with the elongate drive member fastened to an upper wall of the body.
Figure 3B:
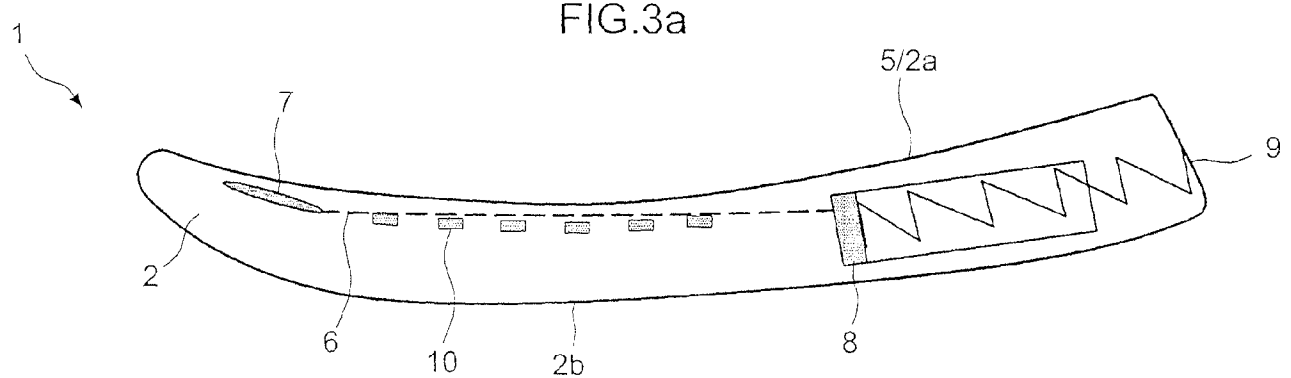
FIG. 3*b* is a cross-sectional view of the body in FIG. 3*a* taken along length of the body.
Figure 3C:
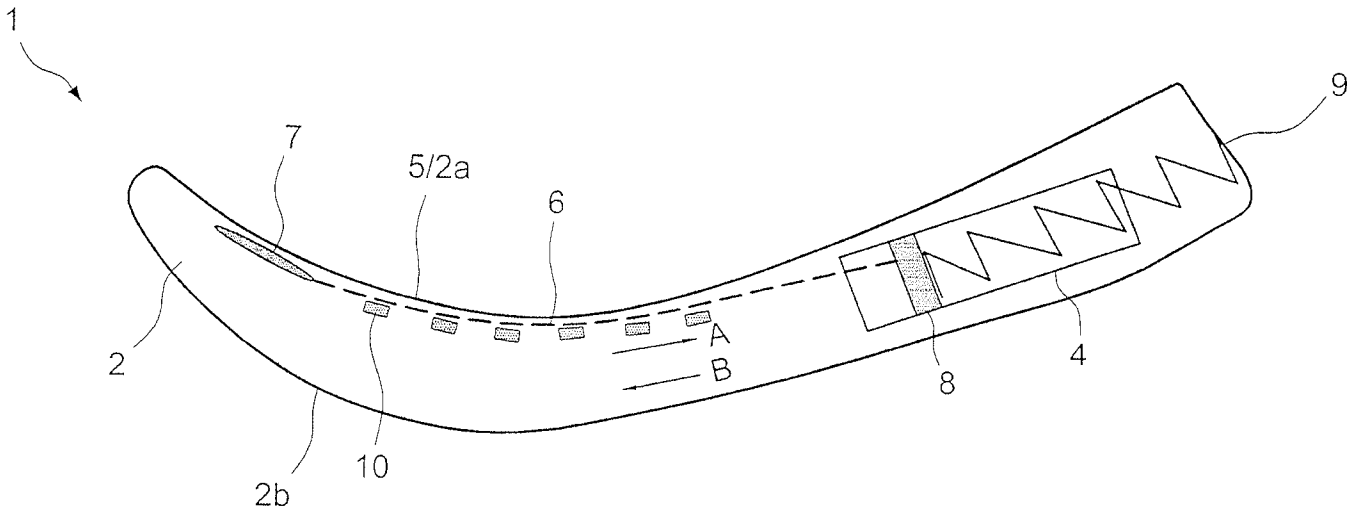
FIG. 3*c* is a cross-sectional view of the body in FIG. 3*b* when it is bent.

A further embodiment of the invention is shown in FIGS. 3*a* to 3*c*. The body portion 5 is the upper wall 2*a*. One end of the cable 6 is fastened to the upper wall 2*a* by the fastener 7. The cable 6 is maintained in close proximity to the upper wall 2*a* by the guides 10. As shown in FIG. 3*a*, when the sole 1 and body 2 are not bent, the spring 9 and the piston 8 are at their default position. More specifically, the spring 9 is stretched and the piston 8 is positioned at a front end of the device 4.

When the sole 1 and the body 2 bend, the upper wall 2*a* contracts or compresses. The cable 6 is caused to slide relative to the upper wall 2*a* in direction A as shown in FIG. 3*c* and the piston 8 is pulled in direction A by the spring 9. Air is sucked into the ventilator 4.

When the sole 1 and the body 2 are unbent, the cable 6 slides relative to the lower wall 2*b* in direction B as shown in FIG. 3*c*. The spring 9 and the piston 8 return to their default positions. The spring 9 is stretched by the relative expansion or decompression of the upper wall 2*a*. This automatically pulls the piston 8 towards the front end of the device 4, as shown in FIGS. 3*a* and 3*b*. Air is pushed out of the ventilator 4.

The movement of the piston 8 inwardly and outwardly of the ventilator 4 brings about ventilation of the sole 1.

For both embodiments as shown in FIGS. 2*a* to 3*c*, the cable 6 is substantially inelastic. Therefore practically does not stretch lengthwise, when the upper or lower wall 2*a* and 2*b* contracts or expands by a given length t, the cable 6 slides relative to the upper and lower wall 2*a* and 2*b* by a distance of approximately t. The piston 8 of the device 4 shifts a distance of approximately t as well.

Figure 4A:
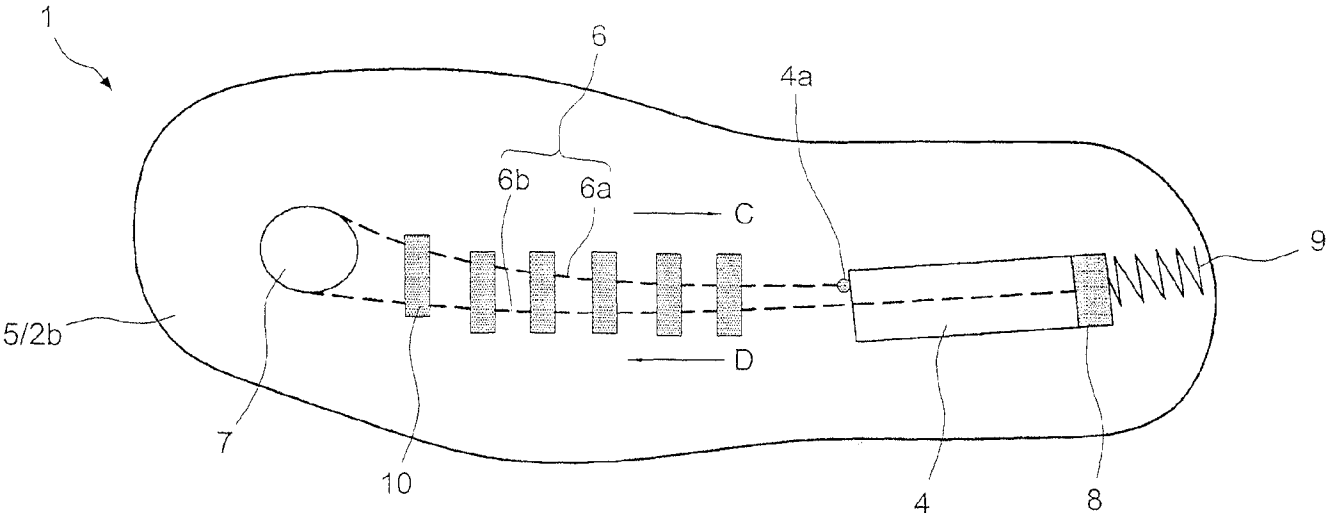
FIG. 4*a* is a top plan view of the body in FIG. 2*a* with the elongate drive member passes the lower wall of the body two times.
Figure 4B:
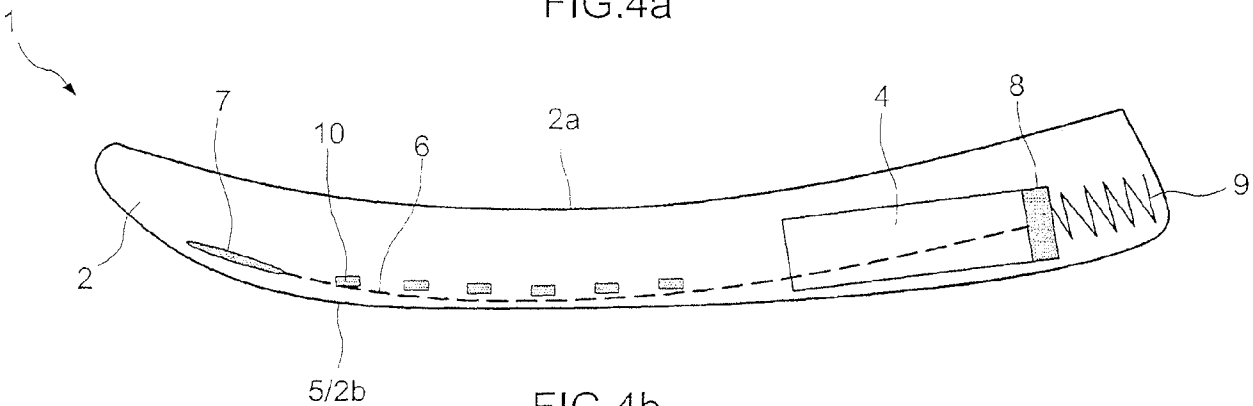
FIG. 4*b* is a cross-sectional view of the body in FIG. 4*a* taken along length of the body.
Figure 4C:
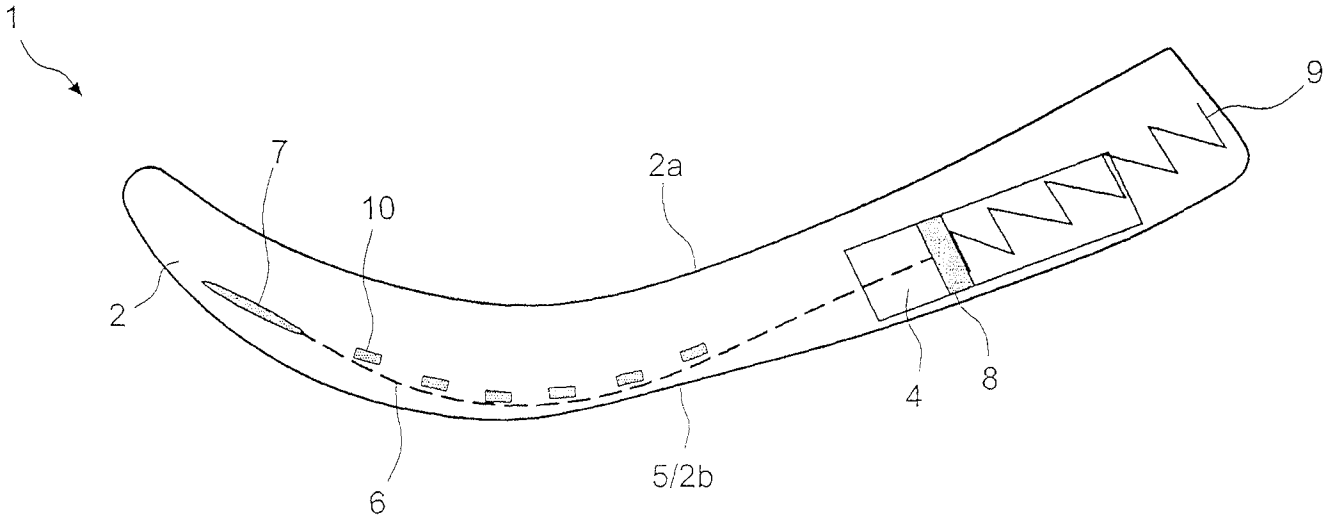
FIG. 4*c* is a cross-sectional view of the body in FIG. 4*b* when it is bent.

Reference is now made to FIGS. 4*a* to 4*c*. The body portion 5 is the lower wall 2*b*. The holder is a direction-changing element such as a pulley 7. The cable runs over or around the pulley 7 to change the direction of sliding of a portion of the cable 6 when it slides. The cable 6 passes the body portion 5 two times by running over the pulley 7 once to turn upon itself through 180°, thereby amplifying displacement of the cable 6 relative to the body portion 5 to increase the drive.

One end of the cable 6 is attached to a casing 4*a* of the device 4 and the other end is attached to the piston 8. The pulley 7 divides the cable 6 into two portions 6*a* and 6*b*. When the lower wall 2*b* expands by a distance t, the portion of the cable 6*a* slides a distance of approximately t in direction C as shown in FIG. 4*a* and the other portion of the cable 6*b* slides a distance of approximately t in direction D as shown in FIG. 4*a*. In total, the cable 6 slides a distance of approximately 2 t and the piston 8 is pulled and shifted a distance of approximately 2 t. The arrangement amplifies the drive of the drive generator 3 by approximately two times as compared to the arrangement as shown in FIGS. 2*a* to 3*c*.

Figure 5:
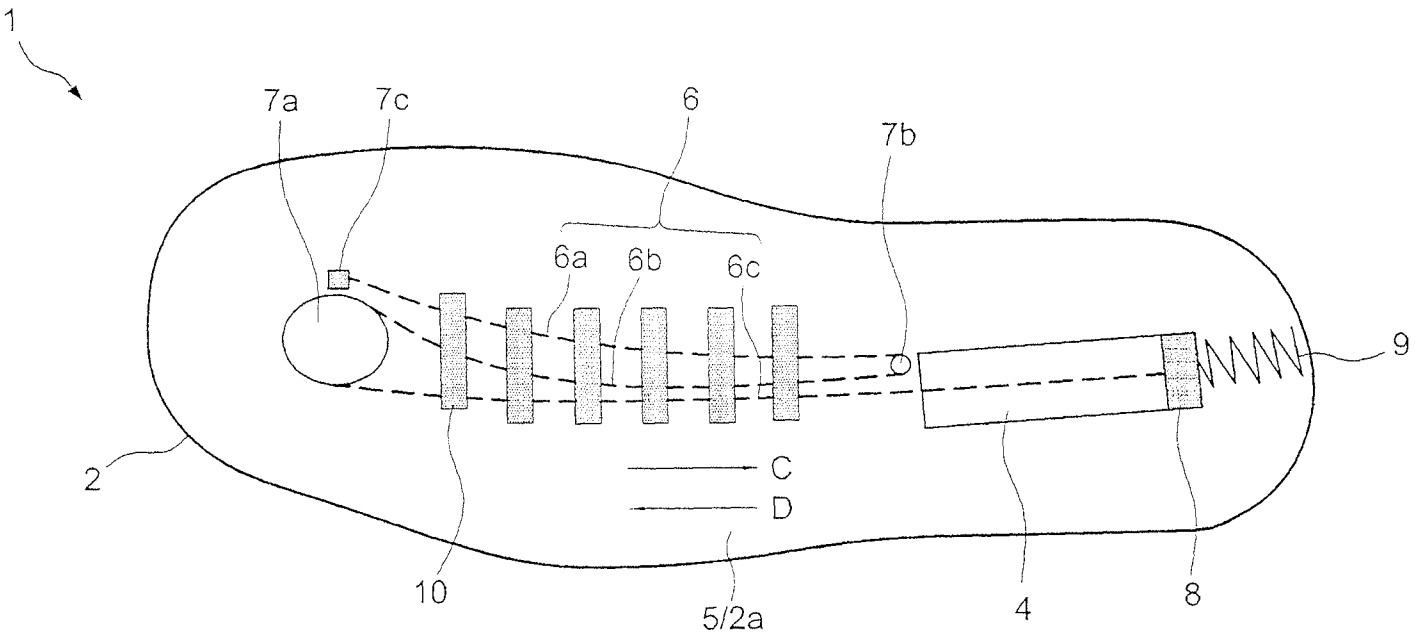
FIG. 5 is a top plan view of the body in FIG. 2*a* with the elongate drive member passes the lower wall of the body three times.

In a further embodiment as shown in FIG. 5, the sole has two pulleys 7*a* and 7*b* and one fastener 7*c*. The cable 6 is fixed to the body 2 by the fastener 7*c*. The cable 6 passes the body portion 5 three times by running over a larger pulley 7*a* once and a smaller pulley 7*b* once so as to amplify the displacement of the cable 6 relative to the body portion 5 for increasing the drive. The cable may be considered as being divided into three portions 6*a*, 6*b* and 6*c*.

As shown in FIG. 5, when the lower wall 2*b* expands lengthwise by a distance of t, the portion of the cable 6*a* slides a distance of approximately t in direction D, the portion 6*b* slides approximately t in direction C and the portion 6*c* slides approximately t in direction D. In total, the cable 6 slides a distance of approximately 3 t and the piston 8 is pulled and shifted a distance of approximately 3 t. The arrangement amplifies the drive of the drive generator 3 by approximately three times as compared to the arrangement as shown in FIGS. 2*a* to 3*c*.

Similarly, one can have n number of t if the cable 6 passes n times past the body portion 5. The cable 6 extends along a boustrophedonic path by passing the body portion for a plurality of times.

Figure 6A:
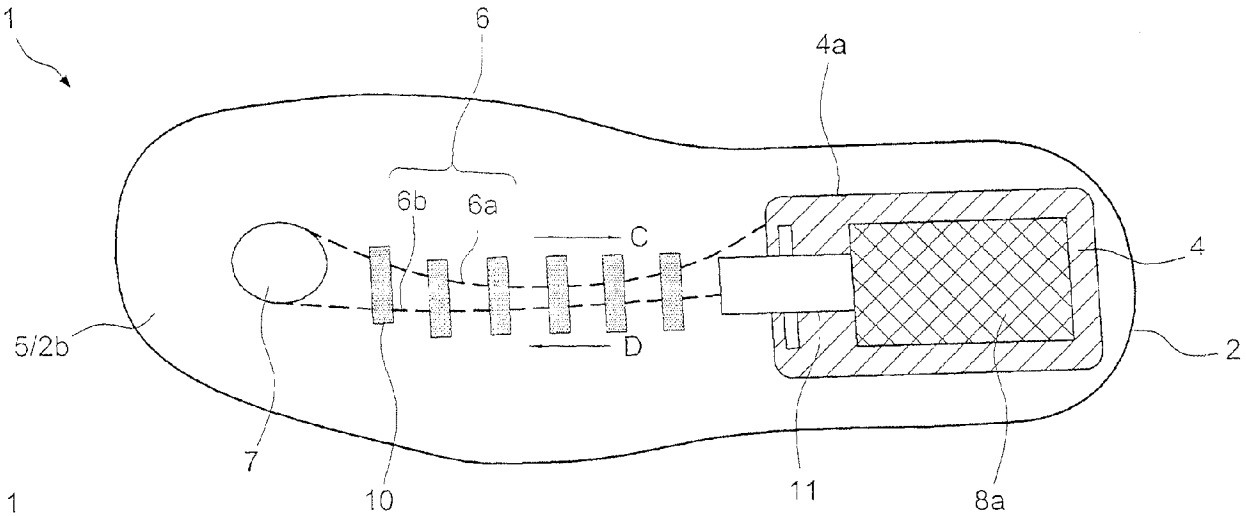
FIG. 6*a* is a top plan view of a body of an embodiment of a sole in accordance with the invention.
Figure 6B:
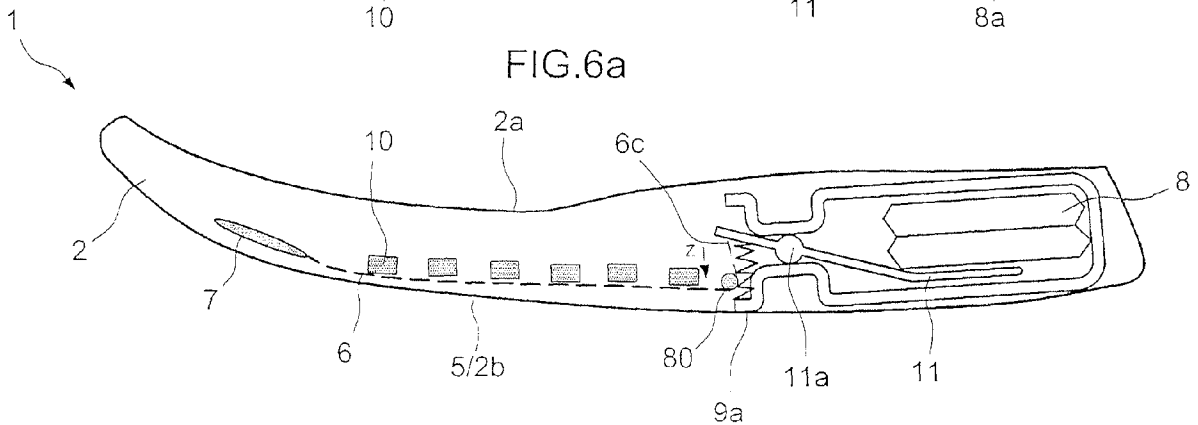
FIG. 6*b* is a cross-sectional view of the body in FIG. 6*a;*
Figure 6C:
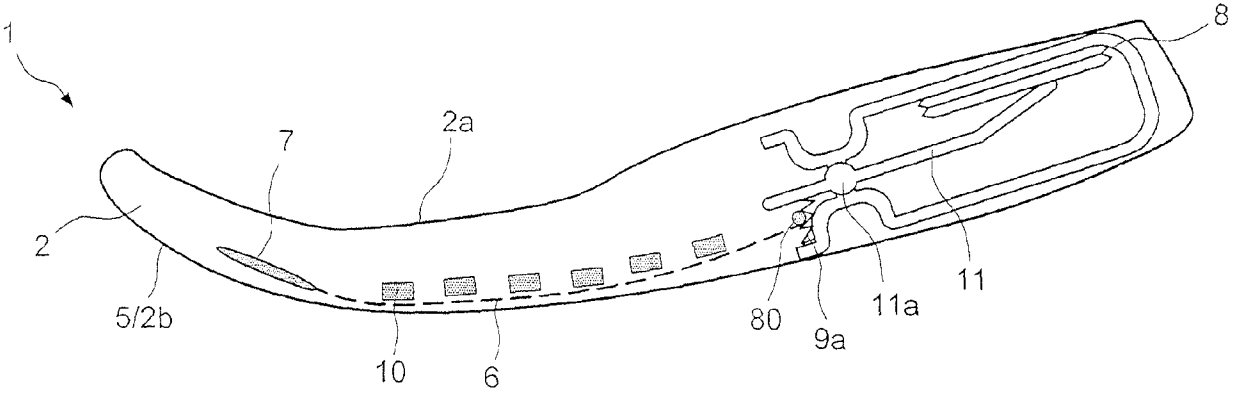
FIG. 6*c* is a cross-sectional view of the body in FIG. 6*a* when it is bent.
Figure 6D:
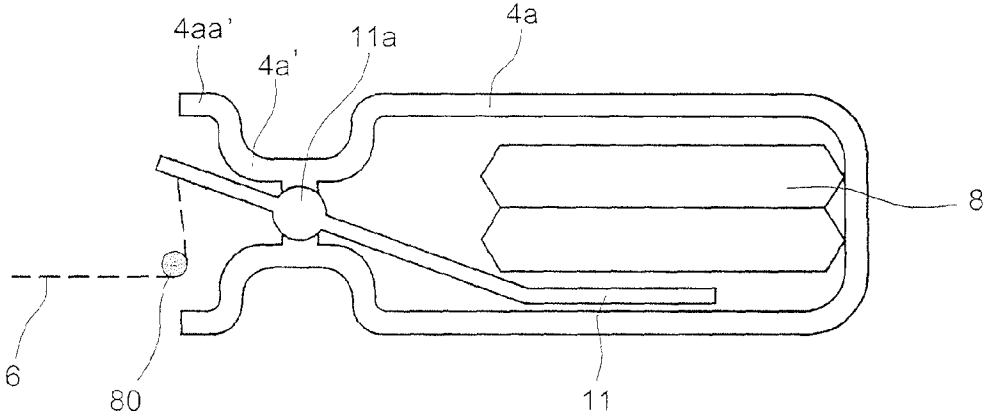
FIG. 6*d* is a cross-sectional view of a part of the drive generator in FIG. 6*b;*
Figure 6E:
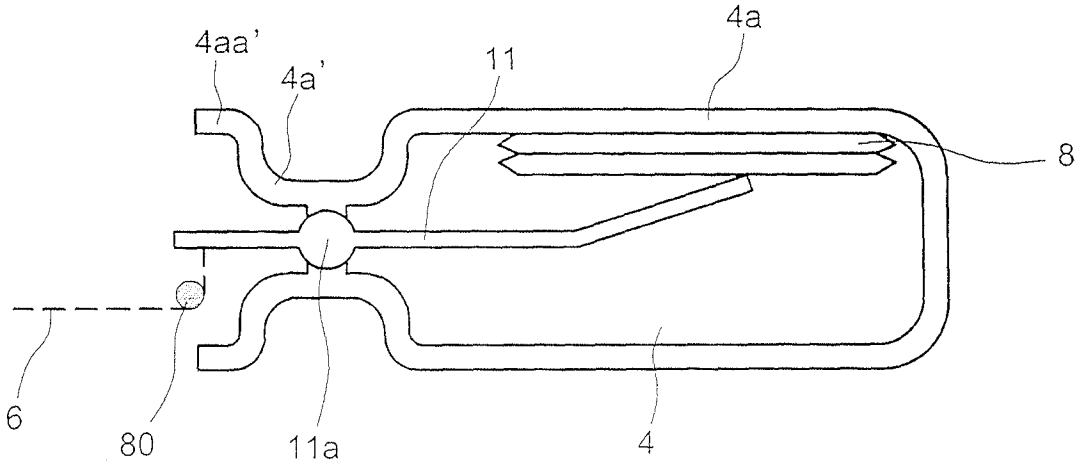
FIG. 6*e* a cross-sectional view of the part of the drive generator in FIG. 6*c* when the body is bent.

Reference is then made to FIGS. 6*a* and 6*e*. The drive generator includes a second drive member which takes the form of a pivoted lever 11 with a pivot 11*a*. Instead of a piston it has a pump 8. At one end, the lever 11 touches the bottom of the pump 8 in the device 4. At the other end, the lever 11 is connected to one end of the cable 6. The cable 6 runs by a smaller pulley 80, adjacent the device 4 and underneath the lever 11, to change the direction of sliding of a first portion of the cable 6*c* when the cable 6 slides. The cable 6 also runs over or round the pulley 7 near the front tip of the sole 1, thereby passing the body portion 5 twice to amplify the displacement of the cable 6. Another end of the cable 6 is attached to casing 4*a* of the device 4.

When the sole 1 and the body 2 are bent, a first portion 6*a* and a second portion 6*b* of the cable 6 are slid relative to the lower wall 2*b* in direction C and D respectively as shown in FIG. 6*a*. A third portion of the cable 6*c* is caused to slide in direction Z perpendicular to the lower wall 2*b*. The lever 11 connected to the third portion 6*c* is caused to pivot and press upon the bottom of the pump 8 thereby deflating it. Air is forced out of the pump 8. The pump 8 is made of resiliently deformable material and will therefore return to its undeflated state when the lever 11 no longer presses against the pump 8 when the sole 1 and the body 2 are unbent. The pump 8 sucks in air to inflate. The deflation and inflation of the pump 8 provide ventilation to the sole 1.

A compression spring 9*a* may be placed at the end of the lever 11 that connects the cable 6 to assist biasing the lever 11 away from the bottom of the pump 8 as the sole 1 and the body 2 unbend.

As shown in FIGS. 6*d* and 6*e*, the device 4 has a casing 4*a* with a neck 4*a*' shaped to accommodate the pivot 11*a* of the lever 11. The neck 4*a*' is followed by a substantially flared hood 4*aa*' to allow pivoting of the lever 11. The pump 8 is placed inside the casing 4*a*.

Figure 7B:
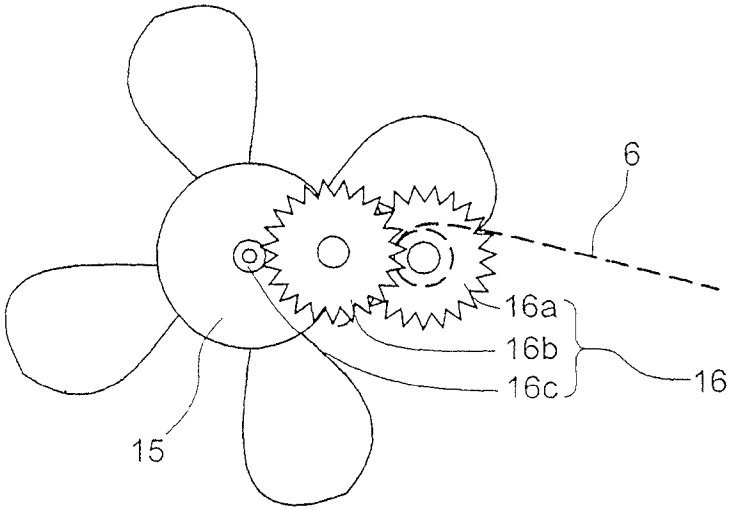
FIG. 7*b* is a drawing of a fan and a gear train provided in a part of the body of another embodiment of a sole in accordance with the invention.
Figure 7A:
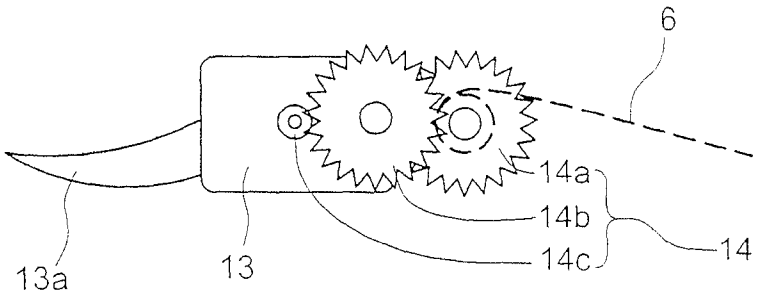
FIG. 7*a* is a drawing of a generator and a gear train provided in a part of the body of an embodiment of a sole in accordance with the invention.

FIG. 7*a* depicts an embodiment of the device 4. The device 4 has a generator 13 which is connected to a gear train 14. The cable 6 is replaced by the thread 6. The gear train 14 is driven by a thread 6. The thread 6 wraps around a first gear 14*a*. The gear 14*a* meshes with a second gear 14*b* which meshes with a third gear 14*c*. When the thread 6 is pulled, the gears

14*a*-14*c* are caused to rotate in a clockwise direction to bring about movement of a fan 13*a* that is connected to the generator 13.

FIG. 7*b* shows another embodiment of the device 4, which includes a fan 15 connected to a gear train 16. The cable is replaced by the thread 6. The gear train 16 is driven by the thread 6 which wraps around a first gear 16*a*. The gear 16*a* meshes with a second gear 16*b* which meshes with a third gear 16*c*. The gears 16*a*-16*c* are caused to rotate in a clockwise direction when the thread 6 is pulled to bring about rotation of the fan 15.

Figure 8:
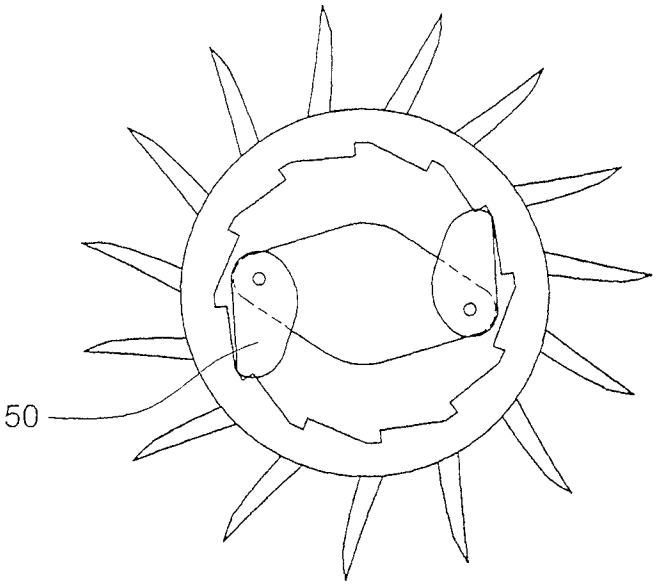
FIG. 8 is a drawing of a ratchet to be attached to back of the fan in FIG. 7*b;*

A clock spring (not shown) can be used to wind the gears 14*a* and 16*a* in anti-clockwise direction. A ratchet 50 as shown in FIG. 8 can be used as a direction limiter of the gear train 14 or 16.

Figure 9:
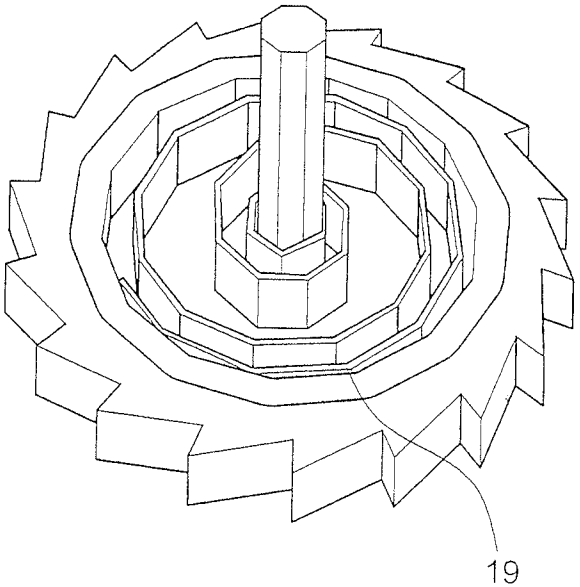
FIG. 9 is an energy storage device provided with the elongate drive member of the sole in FIG. 7*a* or 7*b;*

In another embodiment, the drive generator includes a mechanical energy storage device 19 as shown in FIG. 9 to maintain spinning motion of the fans 13*a* and 15. The energy storage device 19 may be a flywheel or clock spring connected to the plate or cable 6 for storage of energy. The mechanical energy storage device 19 is in serial connection with the cable 6 for outputting the drive from the cable 6 to the device 4.

Figure 10A:
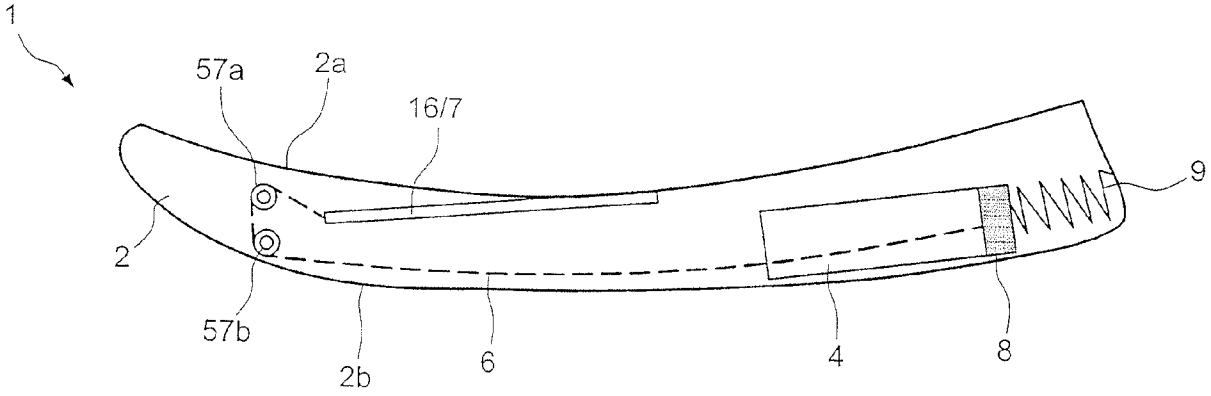
FIG. 10*a* is a top plan view of a body of a further embodiment of a sole in accordance with the invention.
Figure 10B:
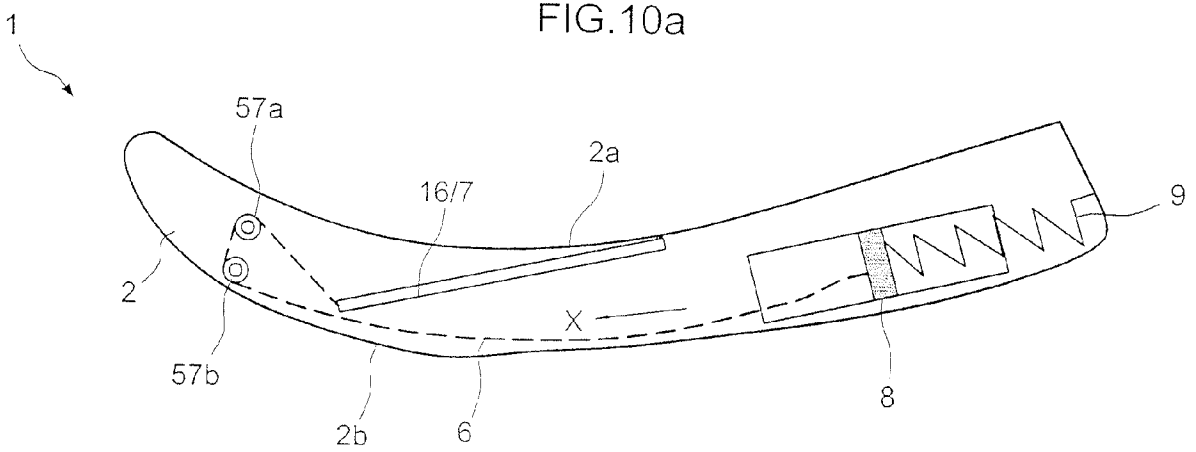
FIG. 10*b* is the cross-sectional view of the body in FIG. 10*a* when it is bent.

In another embodiment of the invention, as shown in FIGS. 10*a* and 10*b*, the holder 7 includes a lever 16 which has a part in engagement with the cable 6 arranged to pivot between first and second positions in response to the bending and unbending of the sole 1 and body 2. One end of the lever 16 is attached to the upper wall 2*a* of the body 2 and the other, free end is engaged with or connected to an end of the cable 6. The cable 6 runs over two pulleys 57*a* and 57*b* and is attached to the piston 8. The cable 6 and the piston 8 are pulled to slide a distance t in direction X as shown in FIG. 10*b* against the action of the spring 9 by the expansion of lower wall 2*b*. The lever 16 is caused to pivot to the second position as shown in FIG. 10*b* when the sole 1 and body 2 bend to provide additional pulling force and movement on the cable 6. Air is then pressed out of the device 4.

When the sole 1 and the body 2 unbend, the lever 16 is pivoted back to the first position as shown in FIG. 10*a*. The cable 6 and the piston 8 are caused to slide in a direction opposite that of direction X. The cable 6 and the piston 8 are then returned to their default positions with the assistance of the spring 9. Air is sucked into the device 4. Ventilation of the sole 1 is achieved by the bending and unbending of the sole 1 and the body 2.

Figure 11A:
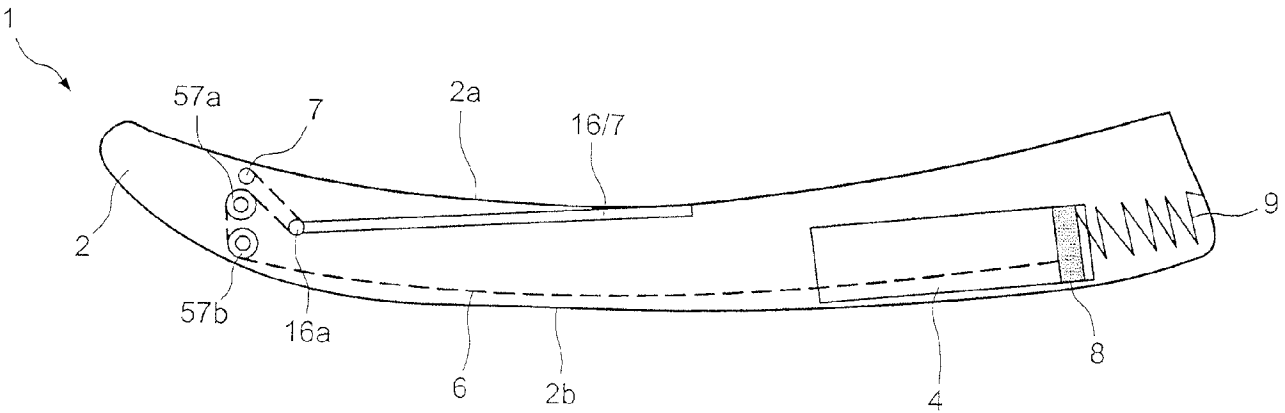
FIG. 11*a* is a top plan view of a body of a further embodiment of a sole in accordance with the invention.
Figure 11B:
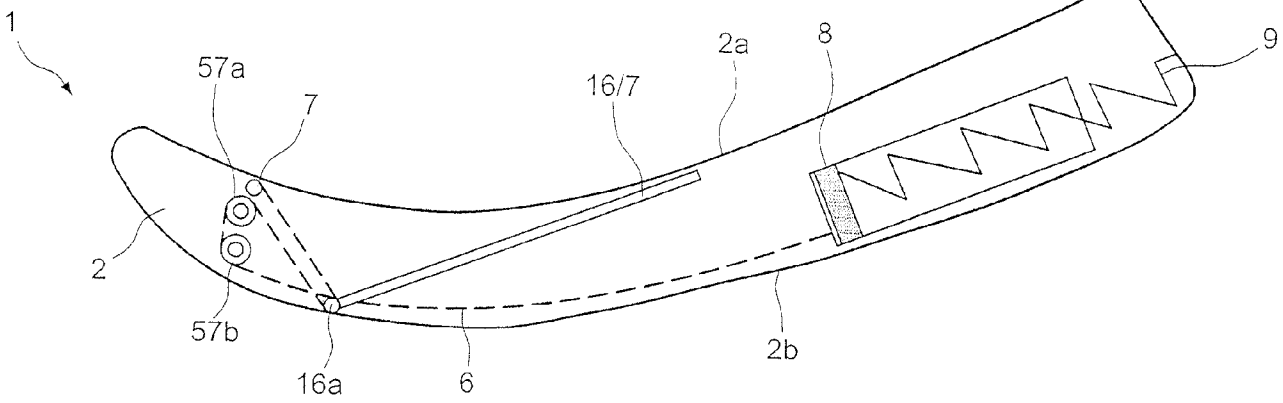
FIG. 11*b* is the cross-sectional view of the body in FIG. 11*a* when it is bent.

The drive generated by the drive generator is amplified by running the cable 6 over or round an additional pulley 16*a* in an arrangement as shown in FIGS. 11*a* and 11*b*. The pulley 16*a* is provided at one end of the lever 16 over which the cable 6 slides in response to bending and unbending of the body 2.

The cable 6 is connected at one end to the piston 8 and then runs over the pulleys 57*a* and 57*b* and also the extra pulley 16*a* before its other end is fastened by a fastener to the upper wall 2*a* of the body 2. The pulling distance created by pivoting the lever 16 from the first position to the second position is doubled by running the cable 6 over the extra pulley 16*a*.

Figure 12A:
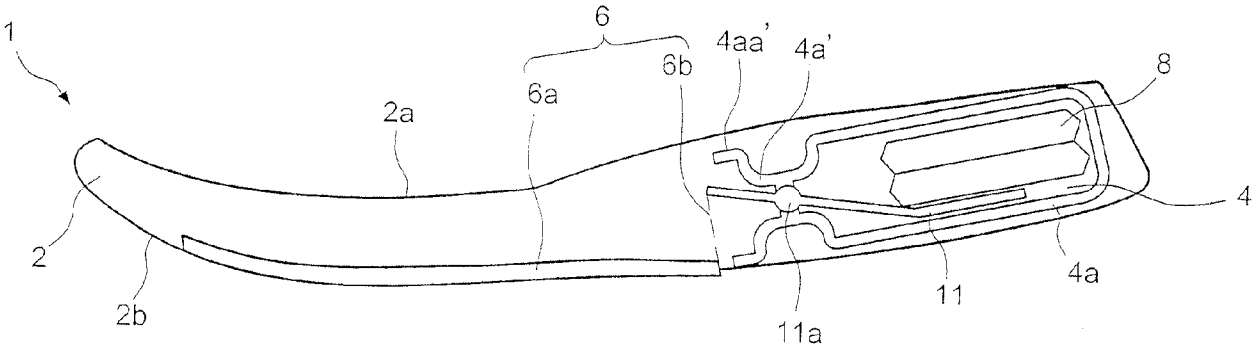
FIG. 12*a* is a top plan view of a body of another embodiment of a sole in accordance with the invention.
Figure 12B:
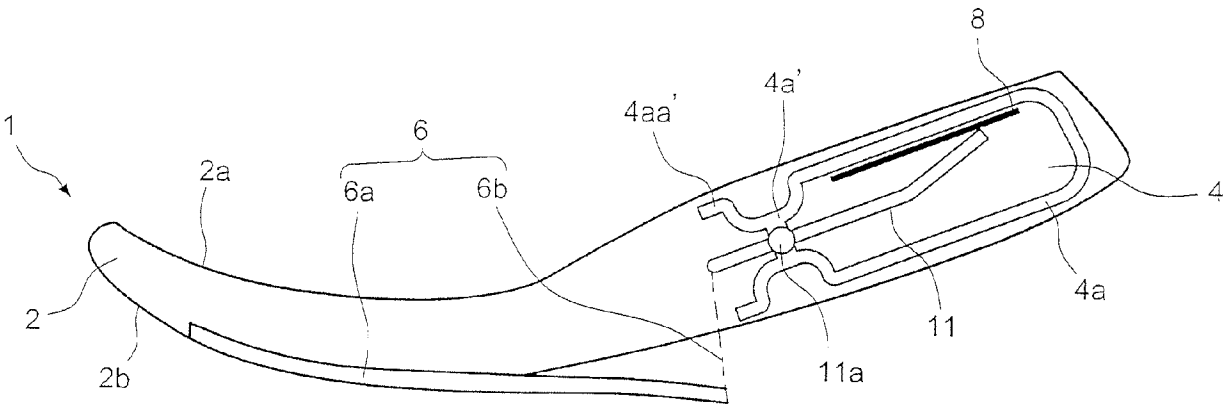
FIG. 12*b* is a cross-sectional view of the body in FIG. 12*a* when it is bent.

FIGS. 12*a* and 12*b* depict a further embodiment of the invention. The lower wall 2*b* of the body has an opening (not shown) which may be covered by a thin resiliently deformable material or it can be left open. A rigid member 6*a* is fixed, at one end of end portion, onto the lower wall 2*b*. The other, second end of the rigid member 6*a* is allowed to flip relative to the body 2 in upward and downward directions substantially perpendicular to the length of the body 2 in order to drive the device 4.

The rigid member 6*a* flips upwardly and downwardly when the sole 1 and body 2 bend and unbend respectively during operation. The second end of the rigid member 6*a* is connected to one end of a pivoted lever 11 by means of a cable 6*b*. The other, free end of the lever 11 bears against the bottom of a pump 8. The pump 8 is placed inside the casing 4*a* of the device 4. When the sole 1 and the body 2 bend, as shown in FIG. 12*b*, the rigid member 6*a* flips relatively downwardly and extends outside the body 2 through the opening. This pulls upon the cable 6*b*. The lever 11 is then caused to pivot.

The free end of the lever 11 presses upon the pump 8 to deflate it. When the sole 1 and the body 2 is unbent, as shown in FIG. 12*a*, the rigid member 6*a* flips relatively upwardly and returns into the body 2 through the opening. The pulling force exerted on the cable 6*b* is removed. The free end of the lever 11 is caused to move in a direction off the pump 8, and the pump 8 is then inflated. The resilience of the pump 8 assists inflation of the pump 8. Air is sucked into the pump 8. Ventilation of the sole 1 is thereby achieved.

Figure 13:
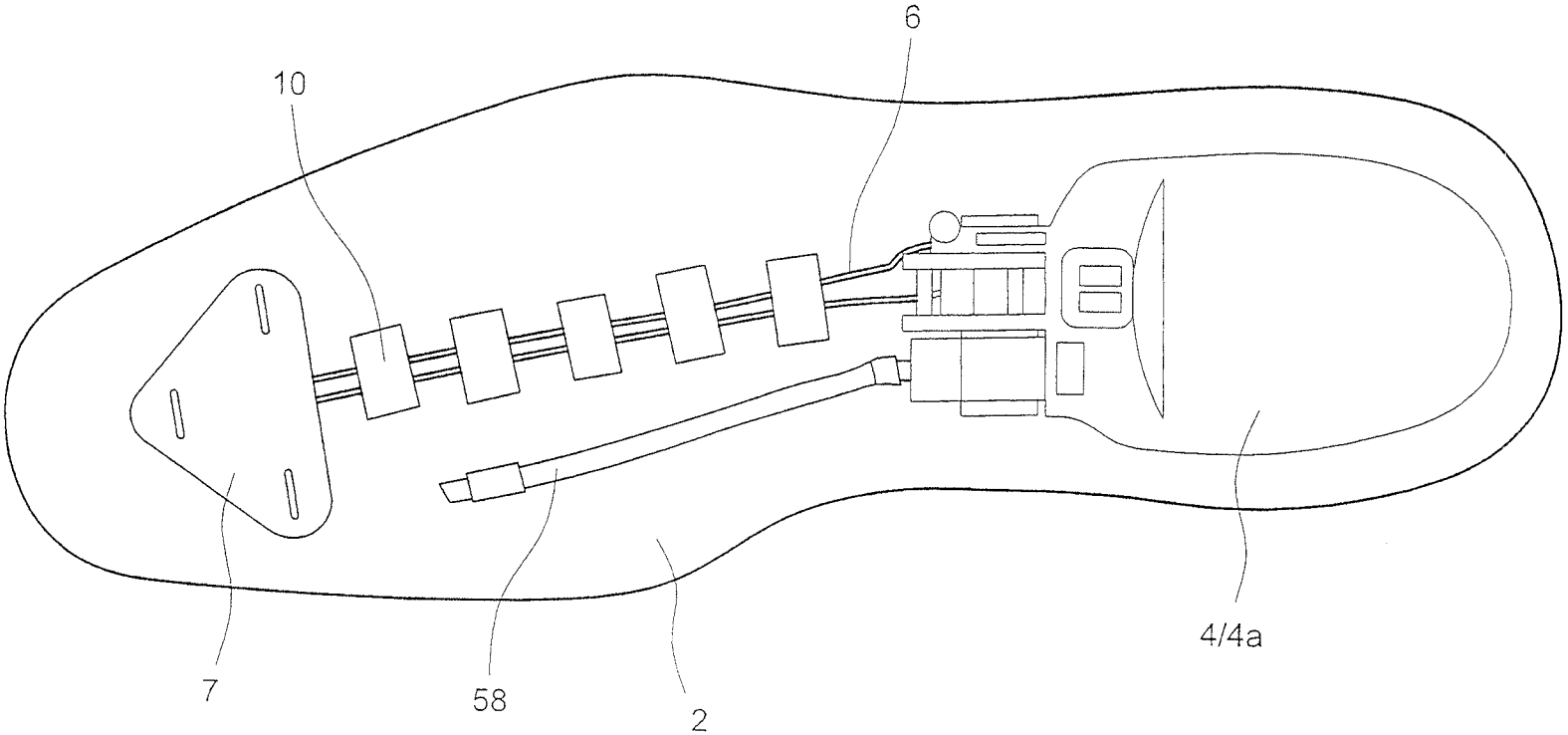
FIG. 13 is a photo of a portion of the body in FIG. 6*a;*
Figure 14:
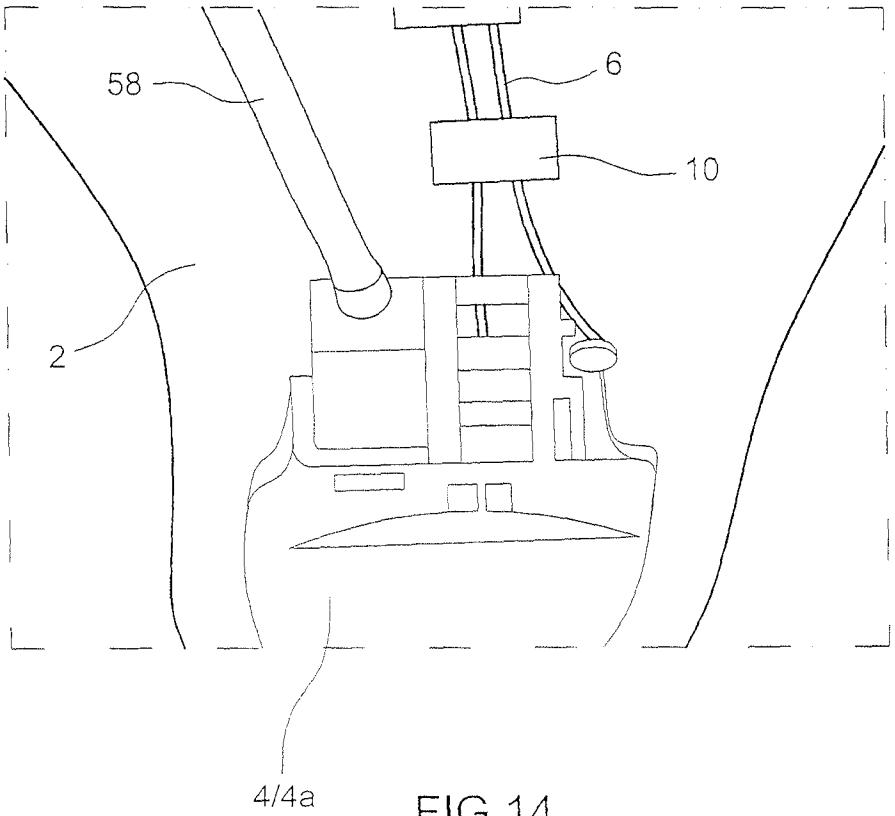
FIG. 14 is an enlarged photo of a portion of the body in FIG. 13.
Figure 15:
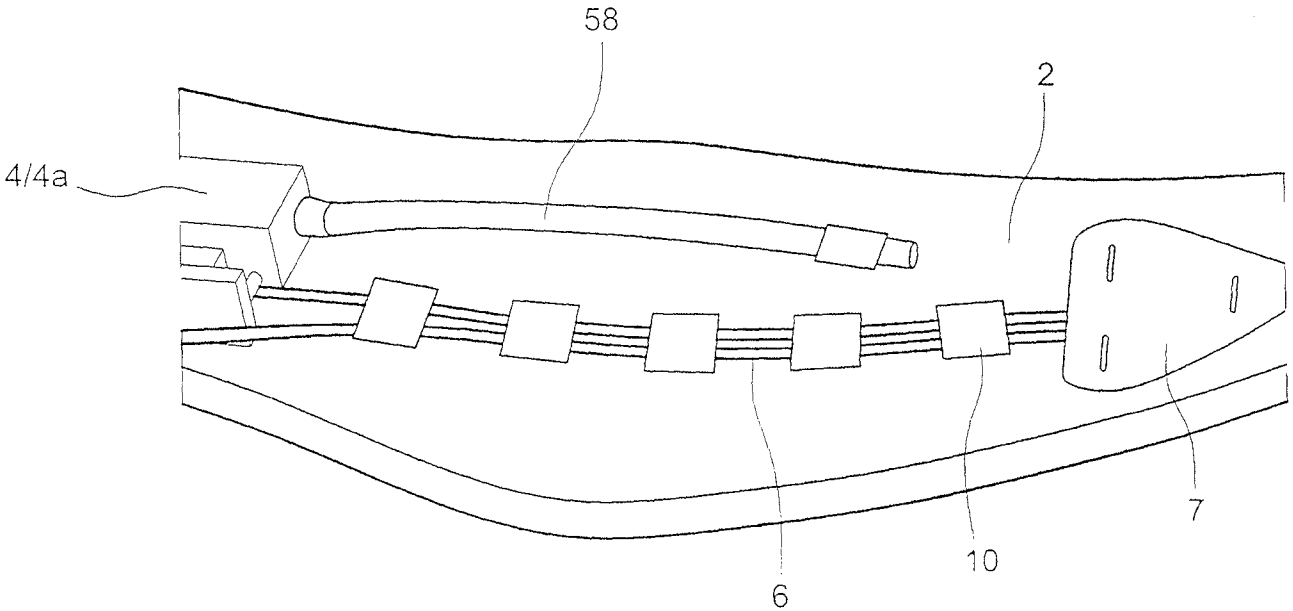
FIG. 15 is an enlarged photo of a portion of the body in FIG. 13.

As shown in FIGS. 13 to 15, the device 4 includes a casing 4 with two openings. One of the openings allows the cable 6 to extend into the casing 4*a*, and the other opening is jointed with a straw or tube 58 which leads air into and out of the device 4.

It should be appreciated that modifications and alterations to the described embodiments obvious to those skilled in the art of sole for footwear, manufacture and use, should not be considered as beyond the scope of the present invention.

For example, instead of the elongate drive member being fastened to the body by a fastener at one end, the elongate drive member may be fastened to the body at any point along the drive member.

In an embodiment, the holder 7 is a pulley. In a different embodiment, the pulley may be any smooth round surface.

In an embodiment, the second drive member 11 is a pivoted lever 11. In a different embodiment, the second drive member may be a rotational pivot, a gear or a friction wheel.

In an embodiment, the device is a ventilator or a fan. In a different embodiment, the device may be an electrical generator or a bulb.

The invention claimed is:

1. A sole for footwear comprising:

a body having a length, and a body portion capable of expansion and contraction; and a drive generator located in the body for generating drive that drives a driven device in the body, wherein the drive generator comprises an elongate drive member arranged to slide relative to the body portion in a direction along the length of the body upon expansion and contraction of the body portion and driving the driven device, as the sole bends and unbends during use.

2. The sole for footwear as claimed in claim 1, wherein the drive member is proximate the body portion.

3. The sole for footwear as claimed in claim 2, including a guide that maintains the drive member in proximity to the body portion while allowing sliding of the drive member relative to the body portion.

4. The sole for footwear as claimed in claim 1, including a holder that holds a part of the drive member to the body.

5. The sole for footwear as claimed in claim 4, wherein the holder comprises a fastener fastening a portion of the drive member to the body.

6. The sole for footwear as claimed in claim 4, wherein the holder comprises a direction-changing element, and the drive member runs over the direction-changing element to change the direction of sliding of a portion of the drive member when the drive member slides.

7. The sole for footwear as claimed in claim 6, wherein the drive member passes the body portion at least two times by running over the direction-changing element to amplify displacement of the drive member relative to the body portion thereby increasing the drive.

8. The sole for footwear as claimed in claim 6, wherein the direction-changing element comprises a roller.

9. The sole for footwear as claimed in claim 7, wherein the drive member passes the body portion a plurality of times to proportionally amplify the displacement of the drive member.

10. The sole for footwear as claimed in claim 7, wherein the drive member extends along a boustrophedonic path by passing the body portion a plurality of times.

11. The sole for footwear as claimed in claim 5, wherein the holder comprises a lever which has a part in engagement with the drive member and is arranged to pivot between first and second positions in response to bending and unbending of the sole to cause the drive member to slide relative to the body portion when the lever pivots between the first and second positions.

12. The sole forte footwear as claimed in claim 11, wherein the lever includes a direction-changing element which is located at the part and over which the drive member slides in response to bending and unbending of the body.

13. The sole for footwear as claimed in claim 1, including a resiliently deformable element, wherein the drive member is tensioned by the resiliently deformable element, which is connected to the drive member.

14. The sole for footwear as claimed in claim 13, wherein the resilient deformable element comprises a spring.

15. The sole for footwear as claimed in claim 1, wherein the drive generator includes a second drive member which is connected to the elongate drive member and which is moved by the elongate drive members to change the direction of the drive generated by the elongate drive member.

16. The sole for footwear as claimed in claim 15, wherein the second drive member comprises one of a rotational pivot, a pivoted lever, a gear, and a friction wheel.

17. The sole for footwear as claimed in claim 1, wherein the elongate drive member is substantially inelastic.

18. The sole for footwear as claimed in claim 1, wherein the elongate drive member comprises one of a thin plate, a ribbon, and a cable made of Dyeema or Kevlar.

19. The sole for footwear as claimed in claim 1, wherein the drive generator includes a mechanical energy storage device connected to the drive member for storage of energy.

20. The sole for footwear as claimed in claim 19, wherein the mechanical energy storage device is serially connected for outputting the drive from the drive member to the driven device.

21. The sole for footwear as claimed in claim 1, wherein the driven device comprises one of a fan, an electrical generator, and a light bulb.

22. The sole for footwear as claimed in claim 1, wherein the body has a thickness within which the drive generator is located in the body.

23. The sole for footwear as claimed in claim 1, wherein the elongate drive member is arranged to flip, relative to the portion of the body, in upward and downward directions that are substantially perpendicular to the length of the body, for driving the driven device, as the sole bends and unbends during use.

24. A sole for footwear comprising:

a body having a wall; and a drive generator located in the body for generating drive to drive a driven device in the body, wherein the drive generator comprises an elongate drive member fixed onto the wall and arranged to flip, relative to the body, in upward and downward directions substantially perpendicular to a length of the wall, for driving the driven device, as the sole bends and unbends during use.

25. The sole for footwear as claimed in claim 24, wherein the drive generator includes a second drive member which is connected to the elongate drive member and moved by the elongate drive member as to changed direction of the drive generated by the elongate drive member.

26. The sole for footwear as claimed in claim 24, wherein the elongate drive member has a first end attached to the body and a second end unattached to the body, and as the sole bends, the second end flips in a direction away from the body.

27. The sole for footwear as claimed in claim 24, wherein the body has a bottom wall with an opening through which a part of the elongate drive member is displaced, outside the body, as the sole bends.

28. The sole for footwear as claimed in claim 24, wherein the wall comprises a bottom wall of the body.

29. The sole for footwear as claimed in claim 24, wherein the elongate drive member is a rigid member.

30. The sole for footwear as claimed in claim 7, wherein the direction-changing element comprises a roller.

* * * * *